US010520186B2

(12) United States Patent
Langius et al.

(10) Patent No.: US 10,520,186 B2
(45) Date of Patent: Dec. 31, 2019

(54) METHOD FOR OPERATING A GAS BURNER APPLIANCE

(71) Applicant: Honeywell Technologies Sarl, Rolle (CH)

(72) Inventors: Gerwin Langius, Hardenberg (NL); Piet Blaauwwiekel, Sleen (NL); Frank Van Prooijen, Sleen (NL); Erwin Kupers, Emmen (NL)

(73) Assignee: Honeywell Technologies Sarl, Rolle (CH)

( * ) Notice: Subject to any disclaimer, the term of this patent is extended or adjusted under 35 U.S.C. 154(b) by 65 days.

(21) Appl. No.: 15/482,403

(22) Filed: Apr. 7, 2017

(65) Prior Publication Data

US 2017/0292698 A1 Oct. 12, 2017

(30) Foreign Application Priority Data

Apr. 7, 2016 (EP) ..... 16164170

(51) Int. Cl.
*F23N 1/02* (2006.01)
*F23N 5/12* (2006.01)
*F23D 14/22* (2006.01)

(52) U.S. Cl.
CPC ..... *F23D 14/22* (2013.01); *F23N 1/022* (2013.01); *F23N 1/025* (2013.01); *F23N 5/123* (2013.01); *F23N 5/126* (2013.01); *F23D 2203/007* (2013.01); *F23D 2208/00* (2013.01); *F23N 2027/20* (2013.01); *F23N 2033/08* (2013.01); *F23N 2041/04* (2013.01)

(58) Field of Classification Search
CPC ..... F23D 14/22; F23N 1/022; F23N 1/025; F23N 5/123; F23N 5/126
USPC ..... 431/12.18
See application file for complete search history.

(56) References Cited

U.S. PATENT DOCUMENTS 7,090,486 B2 * 8/2006 Lochschmied ..... F23N 1/022 431/12
9,234,661 B2 * 1/2016 Young ..... F23N 1/022
(Continued)

FOREIGN PATENT DOCUMENTS

DE 19618573 C1 6/1997
EP 0806610 A2 11/1997
(Continued)

OTHER PUBLICATIONS

The Extended European Search Report for EP Application No. 12169240.4, dated Oct. 24, 2012.
(Continued)

*Primary Examiner* — Gregory L Huson
*Assistant Examiner* — Nikhil P Mashruwala
(74) *Attorney, Agent, or Firm* — Shumaker & Sieffert, P.A.

(57) ABSTRACT

A method for determining an change in an operating condition of a gas burner appliance. In some instances, a calibration of a gas/air mixture may be performed when the combustion quality of the gas burner appliance diminishes. This may be accomplished by adjusting a throttle position of a throttle valve that throttles the gas to the gas burner appliance. After calibration has been performed, a throttle position of the throttle valve is determined, and based on the throttle position determined after calibration, a change of an operating condition of the gas burner appliance is detectable.

19 Claims, 3 Drawing Sheets

(56) References Cited

U.S. PATENT DOCUMENTS

| | | | | |
|---|---|---|---|---|
| 9,657,946 | B2 * | 5/2017 | Young | F23N 1/022 |
| 2009/0111065 | A1 * | 4/2009 | Tompkins | F23N 1/022 431/12 |
| 2015/0247639 | A1 * | 9/2015 | Lovascio | F23N 1/002 431/12 |
| 2016/0281984 | A1 * | 9/2016 | Munsterhuis | F23N 1/022 |
| 2019/0203936 | A1 * | 7/2019 | Hazzard | F23N 5/006 |

FOREIGN PATENT DOCUMENTS

| | | | | |
|---|---|---|---|---|
| EP | 1176364 | A1 | 1/2002 | |
| EP | 2631541 | A1 | 8/2013 | |
| EP | 2667097 | A1 * | 11/2013 | F23N 1/022 |
| EP | 2685167 | A1 | 1/2014 | |
| EP | 2685168 | A1 | 1/2014 | |
| EP | 2685169 | A1 * | 1/2014 | F23N 5/24 |
| EP | 2966354 | A1 | 1/2016 | |
| WO | 9718417 | A1 | 5/1997 | |
| WO | 2004015333 | A2 | 2/2004 | |

OTHER PUBLICATIONS

The Extended European Search Report for EP Application No. 16164170.9, dated Sep. 30, 2016.

Response to Extended Search Report dated Oct. 16, 2017, from counterpart European Application No. 16164170.9, filed Apr. 6, 2018, 19 pp.

* cited by examiner

METHOD FOR OPERATING A GAS BURNER APPLIANCE

This application claims priority to European Patent Application Serial No. 16 164 170.9, filed Apr. 7, 2016, which is incorporated herein by reference.

TECHNICAL FIELD

The present patent application relates to a method for operating a gas burner appliance.

BACKGROUND

EP 2 667 097 A1 discloses a method for operating a gas burner appliance. During burner-on phases, a defined gas/air mixture having a defined mixing ratio of gas and air is provided to a burner chamber of the gas burner appliance for combusting the defined gas/air mixture within the burner chamber. The defined gas/air mixture is provided by a mixing device mixing an air flow provided by an air duct with a gas flow provided by a gas duct. The air flow flowing through the air duct is provided by fan in such a way that the fan speed of the fan depends on a desired burner load of the gas burner appliance, wherein the fan speed range of the fan defines a so-called modulation range of the gas burner appliance.

According to EP 2 667 097 A1, the defined mixing ratio of gas and air of the gas/air mixture is kept constant over the entire modulation range of the gas burner appliance by a pneumatic controller. The pneumatic controller uses a pressure difference between the gas pressure of the gas flow in the gas pipe and a reference pressure, wherein either the air pressure of the air flow in the air duct or the ambient pressure is used as reference pressure, and wherein the pressure difference between the gas pressure of the gas flow in the gas pipe and the reference pressure is determined and controlled pneumatically. The combustion quality is monitored on basis of a signal provided by a combustion quality sensor like a flame ionization sensor.

According to EP 2 667 097 A1, during burner-on phases of the gas burner appliance, the mixing ratio of the gas/air mixture can be calibrated to different gas qualities on basis of the signal provided by the flame ionization sensor. The flame ionization sensor is used to calibrate the gas/air mixture to different gas qualities. The control of the mixing ratio of the gas/air mixture over the modulation range of the gas burner is independent from the flame ionization current.

As mentioned above, EP 2 667 097 A1 discloses a method for operating a gas burner appliance in which the defined mixing ratio of the gas/air mixture is kept constant over the entire modulation range of the gas burner. Only during the calibration mode, the mixing ratio of the gas/air mixture can be changed to compensate for a changing gas quality. However, after a calibration has been executed, the mixing ratio of the gas/air mixture is kept constant over the entire modulation range of the gas burner appliance. The calibration as disclosed by EP 2 667 097 A1, that is used to compensate for a changing gas quality, is performed in a certain subrange of the modulating range of the gas burner close to full-load operation of the same, preferably between 50% (corresponds to a modulation of "2") and 100% (corresponds to a modulation of "1") of full burner load operation.

SUMMARY

Against this background a novel method for operating a gas burner is provided. The method arrangement for operating a gas burner according to the invention is defined in the claim 1.

The calibration of the defined gas/air mixture is performed at any fan speed of the fan within a predefined fan speed range and thereby at any burner load within a predefined burner load range when a difference between an actual value of the signal provided by the combustion quality sensor and a corresponding nominal value is greater than a respective threshold.

After the calibration has been performed, the absolute throttle position is determined, wherein depending from said absolute throttle position determined after calibration, a change of an operating condition of the gas burner appliance is detectable.

According to the invention, the difference between the actual value of the signal provided by the combustion quality sensor and the corresponding nominal value is continuously monitored. If said difference is too big, namely greater than the respective threshold, the calibration of the defined gas/air mixture is performed. The calibration is performed at any fan speed within the predefined fan speed range and thereby at any burner load in the predefined burner load range. After the calibration is completed, the absolute throttle position of the throttle is determined, wherein depending from said absolute throttle position detected after calibration, a change of an operating condition of the gas burner appliance is detectable. The invention provides the ability to determine the reason why the difference between the actual value of the signal provided by the combustion quality sensor and the corresponding nominal value is too big.

The calibration is performed under the assumption of a constant gas quality. Under said assumption, depending from said absolute throttle position of the throttle determined after calibration, at least one of the following changes of operating conditions of the gas burner appliance is detectable: drift of the pneumatic controller, blockage of an air intake, blockage of an exhaust gas chimney, recirculation of exhaust gas.

According to a preferred embodiment, when said calibration of the defined gas/air mixture is performed at a relatively high fan speed and thereby at a relatively high burner load being larger than a respective threshold, and when the absolute throttle position determined after the calibration is within a defined range, no recirculation of exhaust gas becomes detected.

When said calibration of the defined gas/air mixture is performed at a relatively high fan speed and thereby at a relatively high burner load being larger than a respective threshold, and when the absolute throttle position determined after the calibration is outside of a defined range, recirculation of exhaust gas or changing gas quality becomes detected.

Preferably, a gas quality being too poor or—under the assumption of a constant gas quality—recirculation of exhaust gas becomes detected when the absolute throttle position is below a lower threshold of the defined range. A gas quality being too rich becomes detected when the absolute throttle position is above an upper threshold of the defined range.

The invention provides the ability to determine the reason why the difference between the actual value of the signal provided by the combustion quality sensor and the corresponding nominal value is too big, preferably under the assumption of a constant gas quality and thus for other reasons than a changing gas quality.

According to a preferred embodiment, when said calibration of the defined gas/air mixture is performed at a relatively low speed of the fan and thereby at a relatively low burner load being lower than a respective threshold, and when the absolute throttle position determined after the calibration is within a defined range, no drift of the pneumatic controller and no blockage of the air intake and no blockage of the exhaust gas chimney becomes detected.

Preferably, when said calibration of the defined gas/air mixture is performed at a relatively low speed of the fan and thereby at a relatively low burner load being lower than a respective threshold, and when the absolute throttle position after the calibration is outside of a defined range, the absolute throttle after calibration is compared with an absolute throttle position determined after a calibration performed at a relatively high speed of the fan and thereby at a relatively high burner load being higher than the respective threshold.

A drift of the pneumatic controller or a blockage of the air intake of the gas burner or a blockage of the exhaust gas chimney becomes detected when a difference between said absolute throttle positions of the throttle is higher than a respective threshold. A changing gas quality is detected when said difference between said absolute throttle positions of the throttle is lower than a respective threshold.

The invention provides the ability to determine the reason why the difference between the actual value of the signal provided by the combustion quality sensor and the corresponding nominal value is too big, preferably for other reasons than a changing has quality.

BRIEF DESCRIPTION OF THE DRAWINGS

Preferred developments of the invention are provided by the dependent claims and the description which follows. Exemplary embodiments are explained in more detail on the basis of the drawing, in which:

DESCRIPTION

Figure 1:
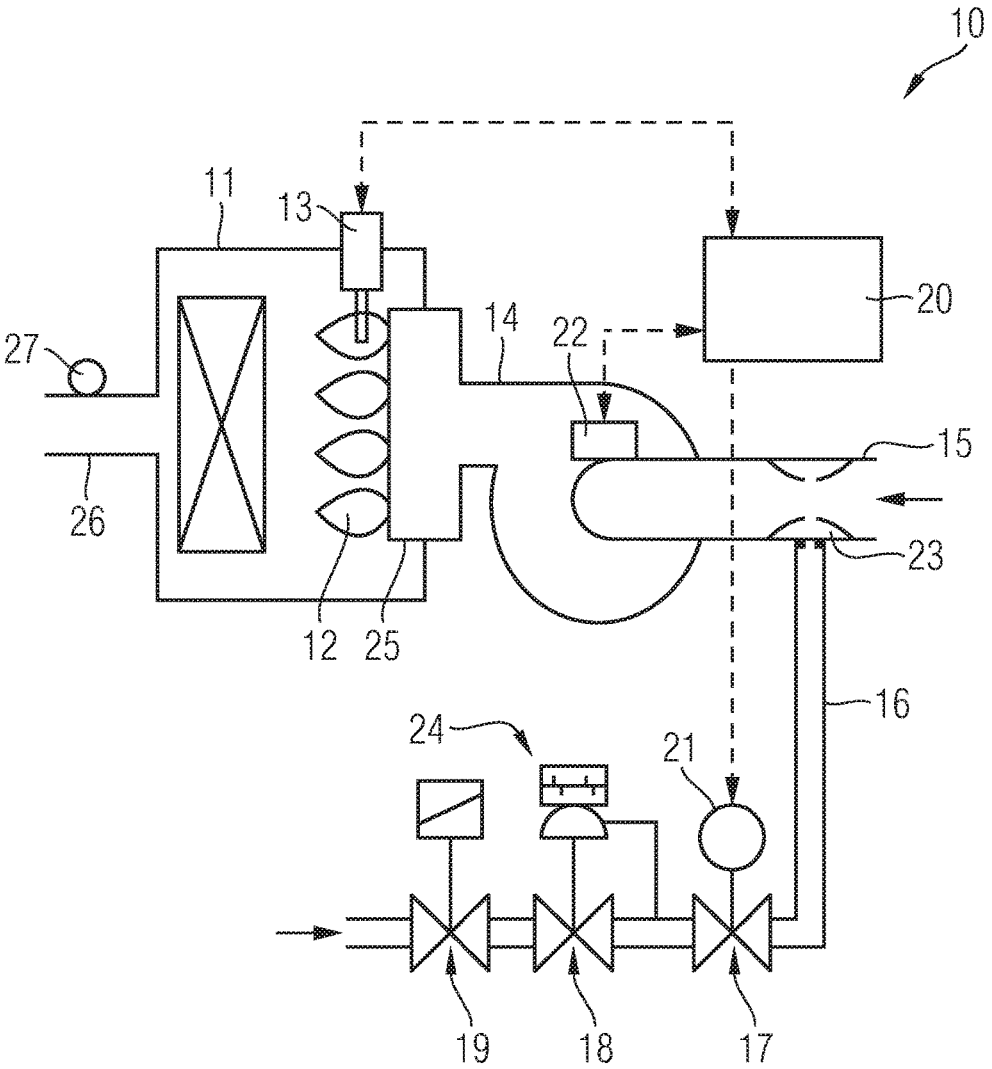
FIG. 1 shows a schematic view of a gas burner.

FIG. 1 shows a schematic view of a gas burner appliance 10. The same comprises a gas burner chamber 11 with a gas burner surface 25 in which combustion of a defined gas/air mixture having a defined mixing ratio of gas and air takes place during burner-on phases of the gas burner appliance 10.

The combustion of the gas/air mixture results in flames 12 monitored by a combustion quality sensor, namely by a flame rod 13.

The defined gas/air mixture is provided to the gas burner chamber 11 of the gas burner appliance 10 by mixing an air flow with a gas flow.

A fan 14 sucks in air flowing through an air duct 15 and gas flowing through a gas duct 16.

A gas regulating valve 18 for adjusting the gas flow through the gas duct 16 and a gas safety valve 19 are assigned to the gas duct 16.

The defined gas/air mixture having the defined mixing ratio of gas and air is provided to the gas burner chamber 11 of the gas burner appliance 10. The defined gas/air mixture is provided by mixing the air flow provided by an air duct 15 with a gas flow provided by a gas duct 16. The air flow and the gas flow become preferably mixed by a mixing device 23. Such a mixing device can be designed as a so-called Venturi nozzle.

The quantity of the air flow and thereby the quantity of the gas/air mixture flow is adjusted by the fan 14, namely by the speed of the fan 14. The fan speed can be adjusted by an actuator 22 of the fan 14.

The fan speed of the fan 14 is controlled by a controller 20 generating a control variable for the actuator 22 of the fan 14.

The defined mixing ratio of the defined gas/air mixture is controlled by the gas regulating valve 18, namely by a pneumatic controller 24 of the same. The pneumatic controller 24 of the gas regulating valve 18 controls the opening/closing position of the gas regulating valve 18.

The position of the gas regulating valve 18 is adjusted by the pneumatic controller 24 on basis of a pressure difference between the gas pressure of the gas flow in the gas duct 16 and a reference pressure. The gas regulating valve 18 is controlled by the pneumatic controller 24 in such a way that at the outlet pressure of the gas regulating valve 18 is equal to the reference pressure.

In FIG. 1, the ambient pressure serves as reference pressure. However, it is also possible to use the air pressure of the air flow in the air duct 15 as the reference pressure. The pressure difference between the gas pressure and the reference pressure is determined pneumatically by pneumatic sensor of the pneumatic controller 24.

The mixing ratio of the defined gas/air mixture is controlled by the pneumatic controller 24 in such a way that over the entire modulation range of the gas burner appliance 10, the defined mixing ratio of the defined gas/air mixture is kept constant. A modulation of "1" means that the fan 14 is operated at maximum fan speed (100% of maximum fay speed) and thereby at full-load of the gas burner appliance 10. A modulation of "2" means that the fan 14 is operated at 50% of the maximum fan speed and a modulation of "5" means that the fan 14 is operated at 20% of the maximum fan speed.

By changing the fan speed of the fan 14, the load of the gas burner appliance 10 can be adjusted. Over the entire modulation range of the gas burner appliance 10, the defined mixing ratio of the defined gas/air mixture is kept constant.

As described above, the mixing ratio of the defined gas/air mixture is controlled during burner-on phases by the pneumatic controller 24 so that over the entire modulation range of the gas burner appliance 10, the defined mixing ratio of the gas/air mixture is kept constant.

During burner-on phases, the defined mixing ratio of gas and air of the defined gas/air mixture can be calibrated.

The calibration is performed by adjusting a position of a throttle 17 within the gas duct 16. The throttle position of the throttle 17 can be adjusted by an actuator 21 assigned to the throttle 17. The controller 20 controls the actuator 21 and thereby the throttle position of the throttle 17 during calibration.

The absolute throttle position of the throttle 17 after calibration can be determined in different ways. With use of a stepper motor as actuator 21, the actual absolute throttle position of the throttle 17 can be determined by counting steps of the stepper motor. With use of a solenoid as actuator 21, the actual absolute throttle position of the throttle 17 can be determined by measuring/controlling the electrical current of the same. It is also possible to determine the absolute throttle position of the throttle 17 after calibration by using a position feedback provided by a sensing element like a Hall sensor assigned to the throttle 17.

The calibration of the defined gas/air mixture as disclosed is performed at any speed of the fan within a predefined fan speed range and thereby at any burner load within a predefined burner load range, namely when a difference between an actual value of the signal provided by the combustion quality sensor, namely by the ionization sensor 13, and a corresponding nominal value is greater than a threshold. The difference between the actual value of the signal provided by the ionization sensor 13 and the corresponding nominal value is determined outside a calibration routine. When said difference becomes too big, the calibration is started.

The nominal value for the signal provided by the ionization sensor 13 is stored within the controller 20.

Said nominal value for the signal provided by the ionization sensor 13 is preferably the ionization current recorded directly after the last calibration routine.

After the calibration has been completed, the absolute throttle position of the throttle 17 is determined, wherein depending from said absolute throttle position determined after calibration, a change of an operating condition of the gas burner appliance 10 is detectable.

So, the difference between the actual value of the signal provided by the combustion quality sensor, namely by the ionization sensor 13, and the corresponding nominal value is continuously monitored. If said difference is too big, namely greater than the respective threshold, the calibration of the defined gas/air mixture is performed.

The calibration is performed at any fan speed within the predefined fan speed range and thereby at any burner load the predefined burner load range. After the calibration is completed, the absolute throttle position of the throttle 17 is determined, wherein depending from said absolute throttle position determined after calibration, a change of an operating condition of the gas burner becomes detected.

The calibration of the defined gas/air mixture is performed under the assumption of a constant gas quality. Depending from said absolute throttle position of the throttle 17 determined after calibration, at least one of the following changes of operating conditions of the gas burner is detectable under said assumption of a constant gas quality: drift of the pneumatic controller 24 of the gas burner appliance 10, blockage of an air intake of the gas burner appliance 10, blockage of an exhaust gas chimney 26 of the gas burner appliance 10, recirculation of exhaust gas into the air or the gas/air mixture within the gas burner appliance 10.

The invention provides the ability to determine the reason why the difference between the actual value of the signal provided by the combustion quality sensor, namely by the ionization sensor 13, and the corresponding nominal value is too big, preferably under the assumption of a constant gas quality and preferably for other reasons than a changing gas quality.

A constant gas quality can be assumed for many gas burner appliances, especially for gas burner appliances installed in countries in which the gas quality does not or hardly change, like in Germany, The Netherlands or in other countries proving a stable gas quality to customers.

Figure 2:
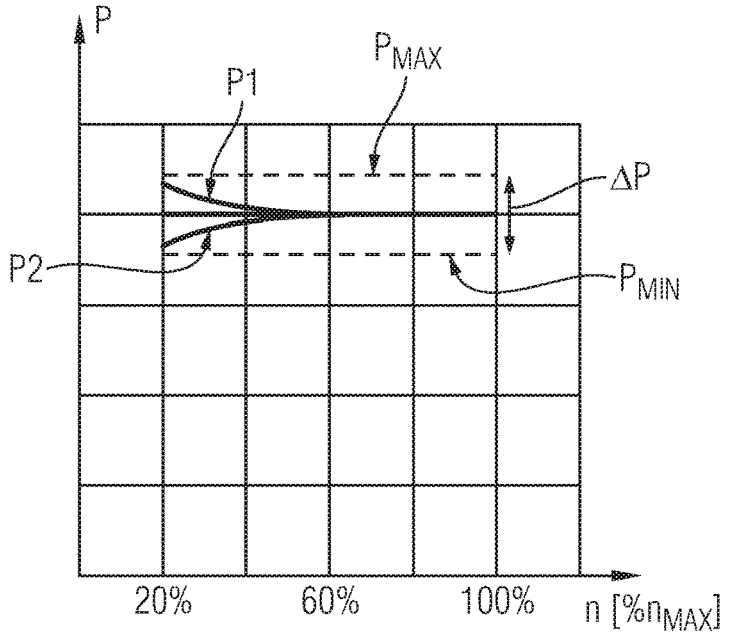
FIG. 2 shows a first diagram illustrating the method for operating a gas burner.
Figure 3:
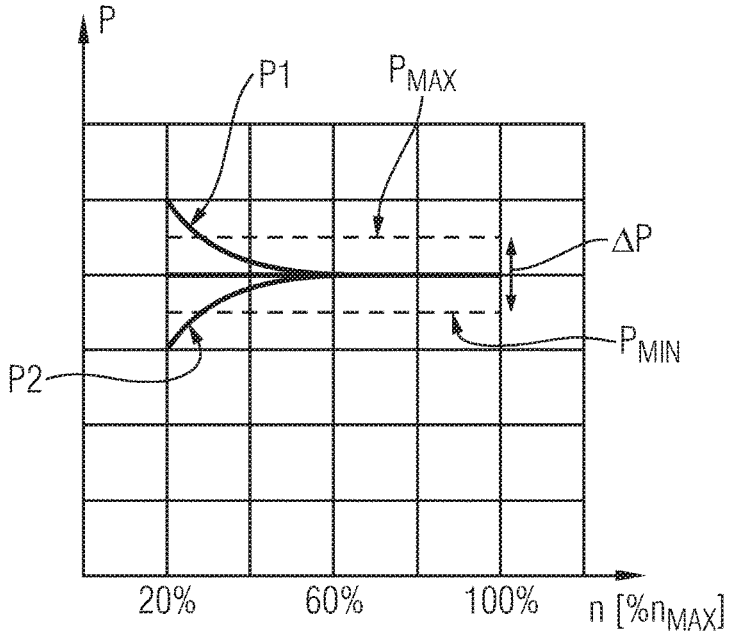
FIG. 3 shows a second diagram illustrating the method for operating a gas burner.
Figure 4:
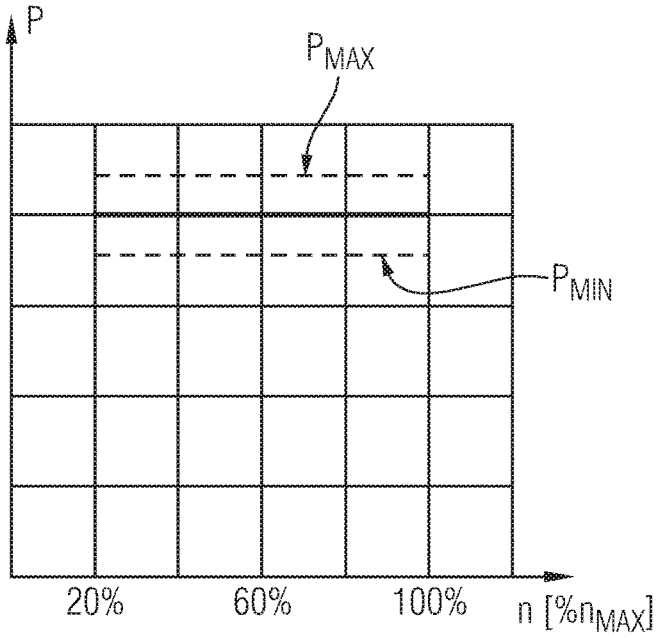
FIG. 4 shows a third diagram illustrating the method for operating a gas burner.

Additional details of the invention will be described below under reference to FIGS. 2 to 4. Each of FIGS. 2 to 4 shows on the x-axis the fan speed n of the fan 14 and on the y-axis the absolute throttle position P of the throttle 17.

The fan speed n of the fan is shown as percentage of the maximum fan speed $n_{MAX}$, wherein a fan speed n of 20% means 20% of maximum fan speed $n_{MAX}$ and thereby a modulation of "5", wherein a fan speed n of 60% means 60% of maximum fan speed $n_{MAX}$ and thereby a modulation of "1.67", and wherein a fan speed n of 100% means 100% of maximum fan speed $n_{MAX}$ and thereby a modulation of "1".

As described above, the calibration is performed at any fan speed within a predefined fan speed range and thereby at any burner load within a predefined burner load range. In the shown embodiments, the predefined fan speed range, in which the calibration is performed, is between 20% of maximum fan speed $n_{MAX}$ and 100% of maximum fan speed $n_{MAX}$. So, the predefined burner load range, in which the calibration is performed, is between a modulation of "1" and a modulation of "5".

The upper limit of said predefined fan speed range or burner load range, in which said the calibration is performed, is at 100% of maximum fan speed or at a modulation of "1".

The lower limit of said predefined fan speed range or burner load range, in which said the calibration is performed, is at least at 20% of maximum fan speed or at least at a modulation of "5". The lower limit of said predefined fan speed range or burner load range, in which said the calibration is performed, can also be at 15% of maximum fan speed and thereby at a modulation of "6.67" or at 10% of maximum fan speed and thereby at a modulation of "10".

When said calibration of the defined gas/air mixture is performed at a relatively low fan speed of the fan 14 and thereby at a relatively low burner load being lower than a respective threshold, e.g. at a fan speed below 50% of maximum fan speed $n_{MAX}$, preferably at a fan speed below 40% of maximum fan speed $n_{MAX}$, most preferably at a fan speed below 33.33% of maximum fan speed $n_{MAX}$—meaning at a predefined burner load below a modulation of "2", preferably at a predefined burner load below a modulation of "2.5", most preferably at a predefined burner load below a modulation of "3", and when further the absolute throttle position P determined after the calibration is within a defined range ΔP defined by an upper threshold $P_{MAX}$ and a lower threshold $P_{MIN}$, no drift of the pneumatic controller 24 and no blockage of the air intake and no blockage of the exhaust gas chimney 26 becomes detected (see FIG. 2).

In FIG. 2, the absolute throttle position P1 and the absolute throttle position P2 are both within the defined range ΔP so that no drift of the pneumatic controller 24 and no blockage of the air intake and no blockage of the exhaust gas chimney 26 becomes detected.

The upper threshold $P_{MAX}$ and the lower threshold $P_{MIN}$ defining the range ΔP depend both from a throttle calibration performed at maximum fan speed and thereby at a modulation of "1".

When said calibration of the defined gas/air mixture is performed at a relatively low speed of the fan 14 and thereby at a relatively low burner load being lower than a respective threshold, e.g. at a fan speed below 50% of maximum fan speed $n_{MAX}$, preferably at a fan speed below 40% of maximum fan speed $n_{MAX}$, most preferably at a fan speed below 33% of maximum fan speed $n_{MAX}$—meaning at a predefined burner load below a modulation of "2", preferably at a predefined burner load below a modulation of "2.5", most preferably at a predefined burner load below a modulation of "3", and when the absolute throttle position P after the calibration is outside of the defined range ΔP (see FIG. 3, the absolute throttle position P1 and the absolute throttle position P2 are at relatively low fan speeds both outside the defined range ΔP), the absolute throttle position determined after calibration is compared with a reference throttle position. Said reference throttle position is an absolute throttle position P determined after a calibration performed at a relatively high speed of the fan 14 and thereby at a relatively high burner load being higher than the respective threshold, e.g. at a fan speed above 50% of maximum fan speed $n_{MAX}$ and thereby at a predefined burner load above a modulation of "2".

It is possible that said absolute throttle position P which is used as reference throttle position has been determined before, preferably immediately before, or will be determined after, preferably immediately after, it has been determined that the absolute throttle position P determined after the calibration performed at a relatively low speed of the fan 14 is outside of the defined range ΔP. If said reference throttle position has been determined beforehand, the comparison with the reference throttle position can be done immediately.

Otherwise, it would be necessary to modulate up the gas burner appliance for the determination of the reference throttle position.

A drift of the pneumatic controller 24 or a blockage of the air intake of the gas burner appliance 10 or a blockage of the exhaust gas chimney 26 outlet of the gas burner appliance 10 becomes detected when said difference between said absolute throttle positions of the throttle 17, namely between the absolute throttle position determined after calibration and the reference throttle position, is higher than a respective threshold. A changing gas quality is detected when said difference between said absolute throttle positionsabsolute positions of the throttle 17 is lower than the respective threshold.

Figure 5:
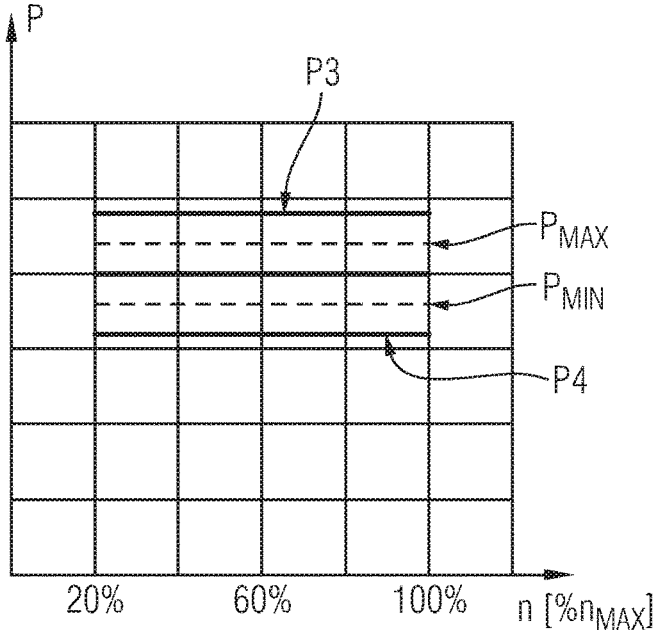
FIG. 5 shows a fourth diagram illustrating the method for operating a gas burner.

When said calibration of the defined gas/air mixture is performed at a relatively high speed of the fan 14 and thereby at a relatively high burner load being larger than a respective threshold, e.g.at a fan speed above 50% of maximum fan speed $n_{MAX}$ and thereby at a predefined burner load above a modulation of "2", and when the absolute throttle position P determined after the calibration is within a defined range ΔP defined by the upper threshold $P_{MAX}$ and the lower threshold $P_{MIN}$ (see FIG. 5), no recirculation of exhaust gas becomes detected.

However, when the absolute throttle position determined after the calibration under these calibration conditions is outside of the defined range ΔP, recirculation of exhaust gas or a changing gas quality becomes detected. When the absolute throttle position P is below the lower threshold $P_{MIN}$ of the defined range ΔP (see curve P4 of FIG. 5), then a gas quality being too poor or, under the assumption of a constant gas quality, recirculation of exhaust gas becomes detected. However, when said absolute throttle position P is above the upper threshold $P_{MAX}$ of the defined range ΔP (see curve P3 of FIG. 5), no recirculation of exhaust gas but a gas quality being too rich becomes detected.

The above described calibration is performed during burner-on phases of the gas burner appliance 10 and started when the continuously monitored difference between the actual value of the signal provided by the combustion quality sensor and a corresponding nominal value is greater than a corresponding threshold.

In the shown embodiment, the ionization sensor 13 is used as combustion quality sensor. Alternatively, an exhaust gas sensor 27 can be used as combustion quality sensor. The exhaust gas sensor may be in the exhaust gas chimney 26, and can be an $O_2$-sensor or CO-sensor.

It should be noted that most gas burner appliances 10 have ignition problems at low temperatures or with gas/air mixtures set to a so-called lambda value being greater than 1.25. So, for a start-up routine at low temperatures of the gas burner appliance 10 or for a start-up routine with gas/air mixtures set to a so-called lambda value being greater than 1.25, the throttle 17 may be opened to a predefined position to create a richer gas/air mixture for the start-up routine of the gas burner appliance 10. This richer gas/air mixture will improve ignition, but also helps to faster establish a stable combustion. When stable combustion is established, the throttle 17 will return to a position providing the defined or desired gas/air mixture.

The above described calibration routine will not be performed during such a start-up routine. The above described calibration routine will only be performed after a stable combustion is established, and after the throttle 17 has returned to a position providing the defined or desired gas/air mixture.

LIST OF REFERENCE SIGNS

10 gas burner appliance
11 gas burner chamber
12 flame
13 flame rod
15 air duct
16 gas duct
17 throttle
18 gas valve/regulating valve
19 gas valve/safety valve
20 controller
21 actuator
22 actuator
23 mixing device
24 pneumatic controller
25 gas burner surface
26 exhaust gas chimney
27 exhaust gas sensor

What is claimed is:

1. A method for operating a gas burner appliance, comprising:

during burner-on phases, providing a defined gas/air mixture having a defined mixing ratio of gas and air to a burner chamber of the gas burner appliance for combusting the defined gas/air mixture within the burner chamber;

said defined gas/air mixture is provided by a mixing device mixing an air flow provided by an air duct with a gas flow provided by a gas duct;

said air flow flowing through the air duct is provided by fan in such a way that the fan speed of the fan depends on a desired burner load of the gas burner appliance, wherein the fan speed range of the fan defines a modulation range of the gas burner appliance;

said mixing ratio of gas and air of the gas/air mixture is controlled over the modulation range of the gas burner appliance by a pneumatic controller on basis of a pressure difference between a gas pressure of the gas flow in the gas duct and a reference pressure, wherein either an air pressure of the air flow in the air duct or an ambient pressure is used as reference pressure, and wherein the pressure difference between the gas pressure and the reference pressure is determined and controlled pneumatically;

during burner on phases the combustion quality is monitored on basis of a signal provided by a combustion quality sensor like a flame ionization sensor, wherein the defined mixing ratio of gas and air of the defined gas/air mixture can be calibrated on basis of the signal provided by the combustion quality sensor, namely by adjusting during calibration a position of a throttle within the gas duct;

the calibration of the gas/air mixture is performed under an assumption of a constant gas quality at any fan speed of the fan within a predefined fan speed range and thereby at any burner load within a predefined burner load range when a difference between an actual value of the signal provided by the combustion quality sensor and a corresponding nominal value is greater than a threshold; and after the calibration has been performed, an absolute throttle position of the throttle is determined, wherein depending from said absolute throttle position determined after calibration, at least one of the following changes of an operating condition of the gas burner appliance is detectable under an assumption of a constant gas quality: drift of the pneumatic controller, blockage of an air intake, blockage of an exhaust gas chimney, and recirculation of exhaust gas.

2. The method of claim 1, wherein when said calibration of the defined gas/air mixture is performed at a relatively high fan speed of the fan and thereby at a relatively high burner load being larger than a burner load threshold, and when the absolute throttle position determined after the calibration is within a defined range, no recirculation of exhaust gas becomes detected.

3. The method of claim 1, wherein when said calibration of the defined gas/air mixture is performed at a relatively high fan speed of the fan and thereby at a relatively high burner load being larger than a burner load threshold, and when the absolute throttle position determined after the calibration is outside of a defined range, recirculation of exhaust gas or changing gas quality becomes detected.

4. The method of claim 3, wherein when said absolute throttle position is below a lower threshold of the defined range, a gas quality being too poor or, under an assumption of a constant gas quality, recirculation of exhaust gas becomes detected.

5. The method of claim 3, wherein when said absolute throttle position is above an upper threshold of the defined range, a gas quality being too rich becomes detected.

6. The method of claim 1, wherein when said calibration of the defined gas/air mixture is performed at a relatively low fan speed of the fan and thereby at a relatively low burner load being lower than a burner load respective threshold, and when the absolute throttle position determined after the calibration is within a defined range, no drift of the pneumatic controller and no blockage of an air intake and no blockage of an exhaust gas chimney becomes detected.

7. The method of claim 1, wherein when said calibration of the defined gas/air mixture is performed at a relatively low fan speed of the fan and thereby at a relatively low burner load being lower than a burner load threshold, and when the absolute throttle position determined after the calibration is outside of a defined range, said absolute throttle position is compared with a second absolute throttle position determined after a second calibration performed at a relatively high fan speed of the fan and thereby at a relatively high burner load being higher than the burner load threshold, wherein drift of the pneumatic controller or blockage of the air intake of the gas burner appliance or a blockage of an exhaust gas chimney becomes detected when a difference between said absolute throttle positions of the throttle is higher than a respective threshold.

8. The method of claim 1, wherein when said calibration of the defined gas/air mixture is performed at a relatively low fan speed of the fan and thereby at a relatively low burner load being lower than a burner load threshold, and when the absolute throttle position determined after the calibration is outside of a defined range, said absolute throttle position is compared with a second absolute throttle position determined after a second calibration performed at a relatively high fan speed of the fan and thereby at a relatively high burner load being higher than the threshold, wherein changing gas quality is detected when a difference between said absolute positions of the throttle is lower than a respective threshold.

9. A method for operating a gas burner appliance comprising:

setting a flow of air into the gas burner appliance through an air intake by changing a fan speed of a fan that provides air into the gas burner appliance, the flow of air is related to a desired burner load of the gas burner appliance;

providing a flow of gas into the gas burner appliance, wherein the flow of gas is controlled by a pneumatic controller, resulting in a mixing ratio of gas and air;

monitoring a combustion quality of the gas burner appliance;

calibrating the mixing ratio by adjusting a throttle position of a throttle that throttles the flow of gas to the gas burner appliance until the monitored combustion quality is within a predetermined combustion quality range; and based at least in part on the throttle position of the throttle after calibration, and under an assumption of a constant gas quality, determining at least one of the following: drift of the pneumatic controller, blockage of the air intake, blockage of an exhaust gas chimney, and recirculation of exhaust gas.

10. The method of claim 9, wherein when said calibrating of the mixing ratio is performed at a relatively high fan speed of the fan and thereby at a relatively high burner load being larger than a burner load threshold, and when the throttle position of the throttle after calibration is within a defined range, no recirculation of exhaust gas is determined.

11. The method of claim 9, wherein when said calibrating of the mixing ratio is performed at a relatively high fan speed of the fan and thereby at a relatively high burner load being larger than a burner load threshold, and when the throttle position of the throttle after calibration is outside a defined range, recirculation of exhaust gas or changing gas quality is determined.

12. The method of claim 11, wherein when said throttle position of the throttle after calibration is below a lower threshold of the defined range, a gas quality being too poor or, under an assumption of a constant gas quality, recirculation of exhaust gas is determined.

13. The method of claim 11, wherein when said throttle position of the throttle after calibration is above an upper threshold of the defined range, a gas quality being too rich is determined.

14. The method of claim 9, wherein when said calibrating of the mixing ratio is performed at a relatively low fan speed of the fan and thereby at a relatively low burner load being lower than a burner load threshold, and when the throttle position of the throttle after calibration is within a defined range, no drift of the pneumatic controller and no blockage of the air intake and no blockage of the exhaust gas chimney is determined.

15. The method of claim 9, wherein when said calibrating of the mixing ratio is performed at a relatively low fan speed of the fan and thereby at a relatively low burner load being lower than a burner load threshold, and when the throttle position of the throttle after calibration is outside a defined range, said throttle position is compared with a second throttle position determined after a second calibration performed at a relatively high fan speed of the fan and thereby at a relatively high burner load being higher than the burner load threshold, wherein drift of the pneumatic controller or blockage of the air intake of the gas burner or a blockage of the exhaust gas chimney is determined when a difference between said throttle positions of the throttle is higher than a respective threshold.

16. The method of claim 9, wherein when said calibrating of the mixing ratio is performed at a relatively low fan speed of the fan and thereby at a relatively low burner load being lower than a burner load threshold, and when the throttle position of the throttle after calibration is outside a defined range, said throttle position is compared with a second throttle position determined after a second calibration performed at a relatively high fan speed of the fan and thereby at a relatively high burner load being higher than the burner load threshold, wherein changing gas quality is determined when a difference between said throttle positions is lower than a respective threshold.

17. A gas burner control assembly for controlling a gas burner appliance, comprising:

an I/O for communicating with a fan actuator, a throttle actuator and a combustion quality sensor of the gas burner appliance; and a controller operatively coupled to the I/O, the controller configured to:

set a flow of air into the gas burner appliance through an air intake by changing a fan speed of a fan that provides air into the gas burner appliance via the fan actuator, the flow of air is related to a desired burner load of the gas burner appliance;

provide a flow of gas into the gas burner appliance, wherein the flow of gas is controlled by a pneumatic controller, resulting in a mixing ratio of gas and air;

monitor the combustion quality of the gas burner appliance via the combustion quality sensor;

calibrate the mixing ratio by adjusting a throttle position of a throttle that throttles the flow of gas to the gas burner appliance via the throttle actuator until the monitored combustion quality is within a predetermined combustion quality range; and based at least in part on the throttle position of the throttle after calibration, and under an assumption of a constant gas quality, determine at least one of the following: drift of the pneumatic controller blockage of an air intake, blockage of an exhaust gas chimney and recirculation of exhaust gas.

18. The gas burner control assembly of claim 17, wherein the controller is configured to perform said calibrating of the mixing ratio at a relatively high fan speed of the fan and thereby at a relatively high burner load being larger than a burner load threshold, and when the throttle position of the throttle after calibration is within a defined range, no recirculation of exhaust gas is determined.

19. The gas burner control assembly of claim 17, wherein the controller is configured to perform said calibrating of the mixing ratio at a relatively high fan speed of the fan and thereby at a relatively high burner load being larger than a burner load threshold, and when the throttle position of the throttle after calibration is outside a defined range, recirculation of exhaust gas or changing gas quality is determined.

* * * * *